US005622256A

United States Patent [19]

Tesar

[11] Patent Number: 5,622,256

[45] Date of Patent: Apr. 22, 1997

[54] AUTOMOBILE SHAPED GOLF BALL PACKAGE

[75] Inventor: Robert J. Tesar, Waxhaw, N.C.

[73] Assignee: Rexam, Inc., Charlotte, N.C.

[21] Appl. No.: 493,006

[22] Filed: Jun. 21, 1995

[51] Int. Cl.[6] ..... B65D 85/00; B65D 73/00

[52] U.S. Cl. ..... 206/315.9; 206/457; 229/116.4

[58] Field of Search ..... 206/457, 315.9; 229/116.4

[56] References Cited

U.S. PATENT DOCUMENTS

| | | | |
|---|---|---|---|
| D. 74,522 | 2/1928 | Rozowsky . | |
| 1,547,176 | 7/1925 | Lazaron . | |
| 1,553,793 | 9/1925 | Rozowsky | 229/116.9 |
| 2,823,844 | 2/1958 | Frankenstein . | |
| 2,890,790 | 6/1959 | Gibson, Jr. | 206/315.9 X |
| 4,055,250 | 10/1977 | Mayhew . | |
| 4,643,349 | 2/1987 | Sheffer . | |
| 4,646,959 | 3/1987 | Sheffer . | |
| 4,804,133 | 2/1989 | Kiyokane . | |
| 5,195,633 | 3/1993 | Kaminski | 206/315.9 |

*Primary Examiner*—Bryon P. Gehman
*Attorney, Agent, or Firm*—Schweitzer Cornman & Gross

[57] ABSTRACT

A folding paperboard construction is provided to hold a plurality of golf balls which function as roller bearings or "wheels" in combination with the folding paperboard package to simulate a vehicle and function as a toy.

7 Claims, 5 Drawing Sheets

AUTOMOBILE SHAPED GOLF BALL PACKAGE

BACKGROUND OF THE INVENTION

Golf balls are traditionally packaged in rectangular sleeves of three or four balls per sleeve, which sleeves themselves are multiply-packaged in units of four or five sleeves in conventional boxes or trays. More recently, some sleeves have been replaced by hexagonal packages having three or more golf balls disposed triangularly therein. Golf ball packaging has traditionally been extremely functional and has not provided the merchandisers of balls with any special forms or shapes to assist in the display and merchandising of packaged golf balls or in the promotion of other products.

SUMMARY OF THE PRESENT INVENTION

The present invention is directed to a new and improved package for golf balls which provides an unusual visual impact as well as a unique manner for displaying golf balls. The new package also has an additional function, that of a toy vehicle. In accordance with the present invention, a folding paperboard construction is provided to hold a plurality of golf balls which function as roller bearings or "wheels" in combination with the folding paperboard package to simulate a vehicle and function as a toy. Thus the golf ball package itself not only provides a unique and spectacular display, but it also may be employed as a toy by children.

The new vehicular shaped golf ball package is made from an appropriately cut and scored blank which is folded and interconnected to form a vehicle "chassis" having arcuate openings at the bottom which retain the golf balls within the package itself in a manner whereby the balls project and may be freely rotated to provide functioning "wheels" for the toy established by the combination of the golf balls and the paperboard package itself. As a further specific aspect of the present invention, a second folded "wraparound" or "overwrap" paperboard structure is placed over the "chassis" to provide the golf ball package with certain additional details of a motor vehicle, such as wheel covers and body parts.

As will be appreciated, the particular shape of the vehicle replicated or simulated by the golf ball package of the present invention may be modified by changing the chassis and/or the overwrap in such a manner as to depict any wheeled vehicle from a car to a truck to a golf cart, etc. The package itself is of a configuration that lends itself to additional use as a toy and has substantial play value both before and after the golf balls have been removed from the package.

The foregoing advantages as well as other attendant advantages obtained from the practice of the invention will be better appreciated by reference to the following detailed description of the new golf ball package taken in conjunction with the accompanying drawings.

DETAILED DESCRIPTION OF THE INVENTION

Figure 8:
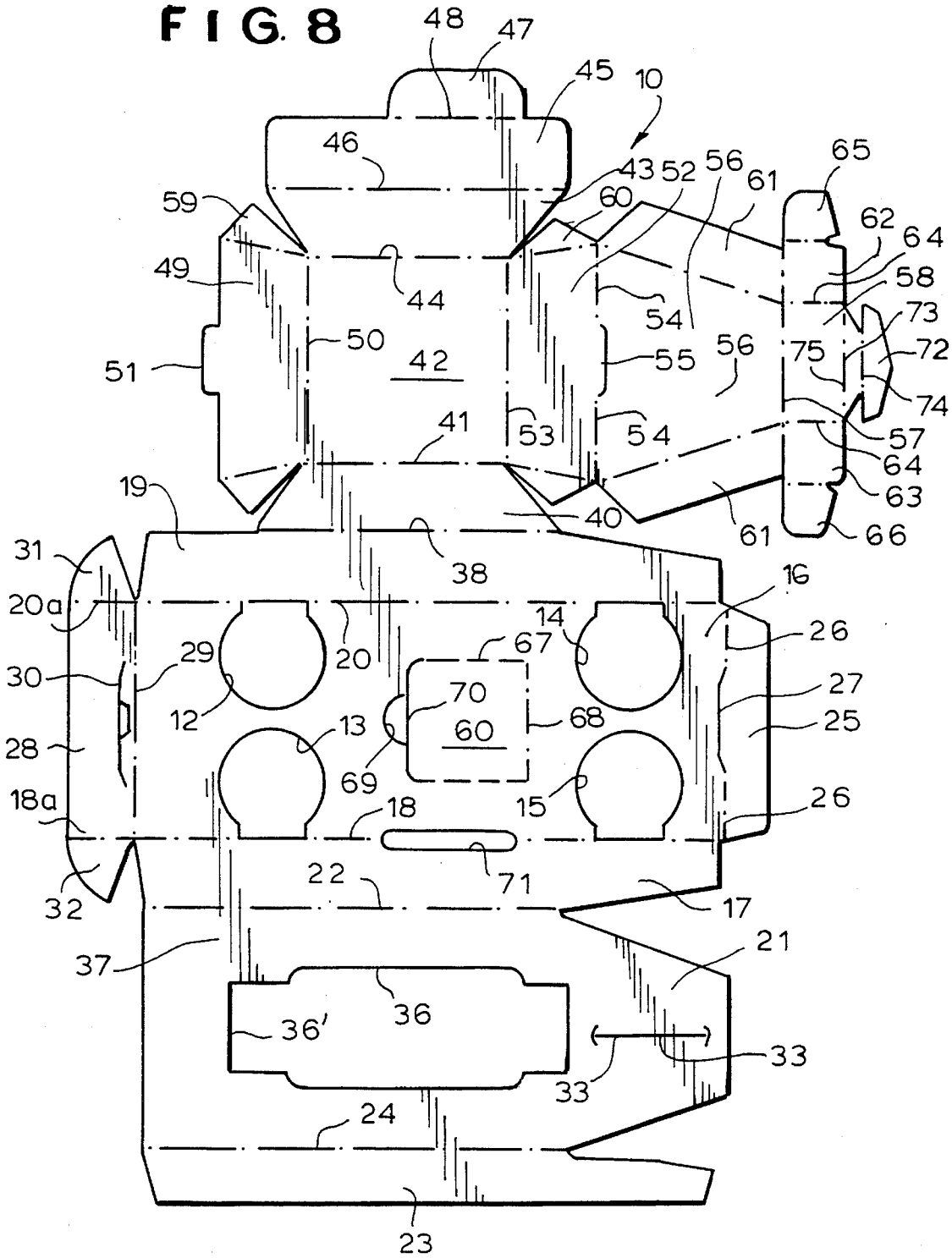
FIG. 8 is a plan view of the paperboard blank for the chassis of the golf ball package of the invention.

In accordance with the principles of the invention, a new promotional golf ball package in the shape of a vehicle having four wheels may be assembled in a variety of vehicular shapes utilizing a chassis blank 10 such as shown in FIG. 8 which is cut and scored and foldable into a chassis element 11 having the fundamental elements of a motor vehicle. The chassis structure 11 includes four golf ball receiving circular cutouts 12, 13, 14, and 15, the diameters of which cutouts are slightly less than the major diameter of the golf balls to be packaged. The ball holding cutouts 12–15 are formed in a bottom wall panel 16 to which is articulated a first side wall panel 17 along one side edge 18 of the bottom wall panel and to which a second side wall panel 19 is articulated along a second score line 20 parallel to score line 18. A top panel 21 is articulated to the first side panel 17 along a score line 22 and a glue lap 23 is articulated to the other edge of the panel 21 along a score line 24, the score lines 22 and 24 being parallel to the score lines 18 and 20.

The glue flap 23 is adapted to be adhered to the side wall panel 19 when that panel is folded perpendicularly to the bottom panel 16 and when the side panel 17 is similarly folded perpendicular to the bottom panel 16 to permit the top panel 21 to be deployed generally parallel to the bottom panel and to form an open golf ball retaining sleeve into which golf balls may be loaded as will be understood.

The chassis unit 11 further includes an inner front panel 25 articulated to the front edge of the panel 16 along basic lines of weakness or score lines 26 interrupted by a cut slot 27. The opposite or rear edge of the chassis panel 16 has a rear panel 28 articulated thereto along score line 29. Panel 28 has an erection slot 30 formed therein. Assembly flaps 31, 32 are articulated to the edges of the panel 28 along score lines 20A and 18A which are collinear with the aforementioned score lines 18 and 20. The panel 21 is shaped generally in the form of a trapezoid at its forward edges and includes a cut line 33 in central portions thereof to permit shaping of the golf ball retaining sleeve as will be described in detail hereinafter. The panel 21 also has a central portion removed by the formation of elongated opening 36. It will be appreciated that the paperboard 37 of the panel 21 which surrounds the opening 36 will be juxtaposed above each of the golf ball retaining openings 12, 13, 14, and 15 and will exert a holding force on the golf balls when they are inserted in the sleeve between the panels 16 and 21.

Articulated to the side wall panel 19 along a score line 38 is a top structure generally replicating the front and rear, the windshield and rear window of a vehicle, side windows of a vehicle, and the hood and grille portions of a vehicle. More specifically, a first vehicle window portion 40 is articulated along the score line 38 and is generally trapezoidal in shape and is itself articulated along score line 41 to a generally square vehicle roof panel 42 to which an opposite side window 43 is articulated along score line 44. An outer auxiliary side panel 45 is articulated to the window panel 43 along score line 46 and the panel 45 has an assembly tab 47 articulated thereto along score line 48. The roof panel 42 has a rear window panel 49 articulated thereto along a score line 50; the rear panel including an assembly tab 51 on its outer edge. A front window panel 52 is articulated to the front edge of the roof panel 42 along a score line 53. The front window panel has articulated thereto along a score line 54 interrupted by an assembly tab 55. A hood-forming panel 56 which is generally trapezoidally shaped as shown. Articulated to the front edge of the hood panel along score line 57 is a front grille panel 58.

Assembly flaps 59 are articulated to the outer edges of the rear window panel as shown; assembly flaps 60 are articulated to the end edges of the front window panel 52 as shown; assembly flaps 61 are articulated to the side edges of the hood panel 56; grille wings 62, 63 are articulated to the grille panel 58 along score lines 64. The grille wings 62, 63 have assembly flaps 65, 66 articulated thereto.

The chassis blank illustrated in FIG. 8 further includes an access door 66 (for ball removal) formed by a series of cuts 67 in the form of a U to permit the door 66 to be hinged downwardly and outwardly from the chassis along a score line 68. To facilitate grasping and folding of the door 66, a finger hole 69 which is semicircular in shape is formed adjacent the free edge 70 of the opening panel 66. In addition, an elongated slot 71 is formed along the score line 18 to facilitate folding and assembly of the chassis components of the golf ball package of the present invention.

In accordance with the invention, after the aforementioned blank 10 is folded to the golf ball retaining sleeve 11 formed by the cooperation of the panels 21 and 16 after the glue lap 23 is adhered by adhesive or hot melt to the side panel 19. Thereafter the top assembly may be folded to form a truncated pyramid shaped top by folding along the score lines 50, 53, 44, 41 and tucking in the flaps 59 and 60 and inserting the assembly panel 47 into the assembly slot 71. At this point, the hood flaps 61 will be infolded underneath the hood panel 56 and lifted upwardly.

Figure 7:
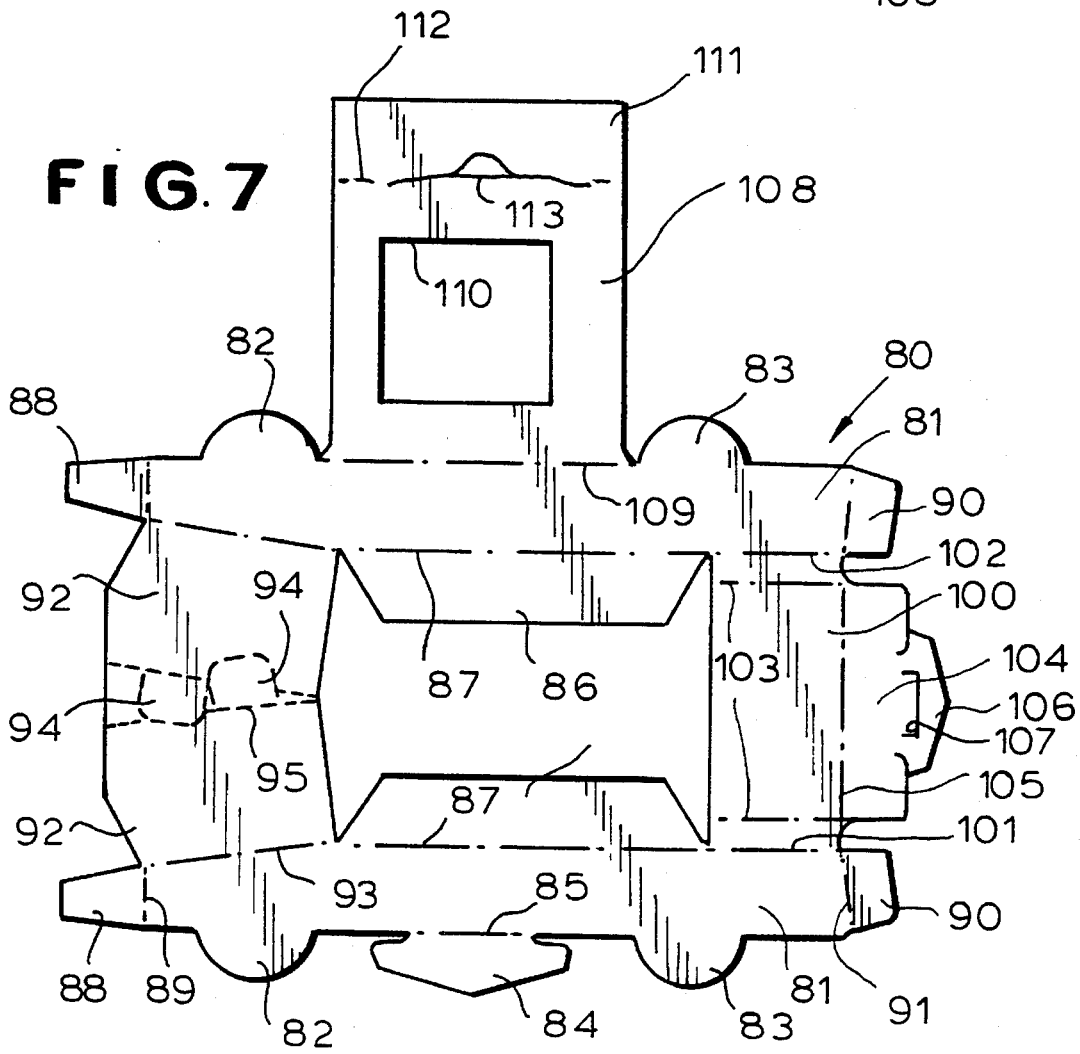
FIG. 7 is a plan view of the paperboard blank for the overwrap portion of the new golf ball package.

The aforementioned chassis is in the general shape of a vehicle is provided with appropriate finishing details by an overwrap which provides further verisimilitude to the golf ball package as will be understood. With reference to FIG. 7, the overwrap blank 80 includes an outer side panel 81 having front wheel covers 82 and a rear wheel cover 83 and also having a foldable assembly tab 84 articulated to the lower portion thereof along score line 85. An assembly flap 86 is articulated to the upper edge of the outer side wall panel 81 along score line 87. At the front edge of panel 81 an assembly flap 88 is hinged to the panel 81 along a score line 89. A rear flap 90 is articulated to the panel 81 along a score line 91. A front hood-forming panel 92 is articulated to the upper front edge of the panel 81 a score line 93. The panel 92 includes an assembly tab 94 articulated thereto along a score line 95.

The blank 80 includes mirror image panels which for the sake of convenience are identified by the same reference numerals with primes. Bridging the rear portions of the panels 81 and 81' is a rear deck panel 100 articulated to the panel 81' along score line 102 and articulated to the panel 81 along score line 101. The panel 100 includes parallel score lines 103 which will contribute to the shaping of the rear deck 100 in the formation of the final vehicular shaped golf ball package.

Articulated to the rear edge of the panel 100 along score line 105 is an assembly panel 104 which includes an arrow shaped assembly tab 106 and a U-shaped assembly slot 107.

A bottom reinforcing panel which is generally square in shape is articulated along score line 109 to the panel 81' between the wheel cover portions 82', 83'. The panel 108 includes a square cutout 110 and also has an assembly flap 111 articulated thereto along a score line 112 interrupted by a cut 113 forming an assembly slit.

Figure 1:
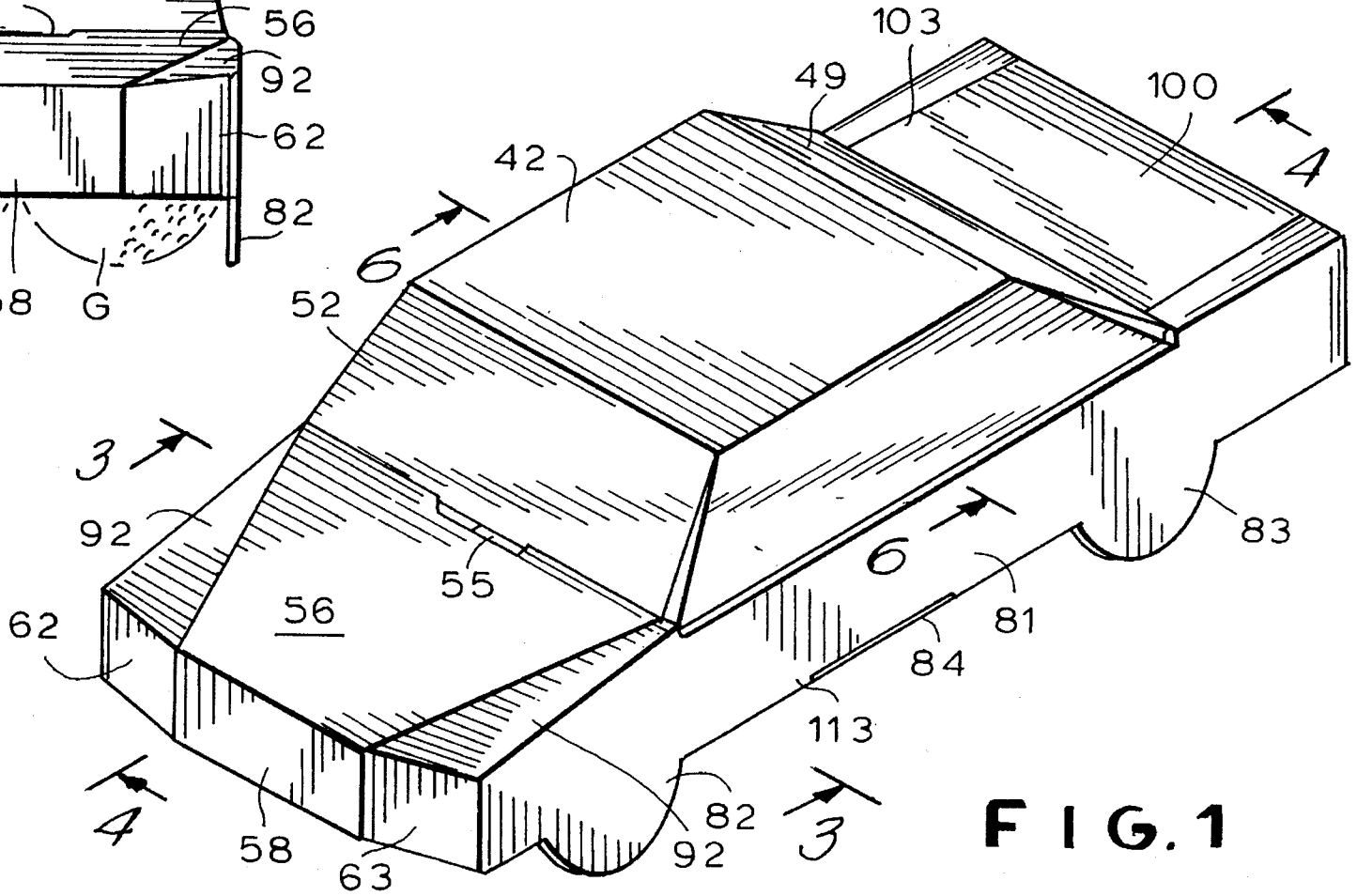
FIG. 1 is a perspective view of the new vehicular shaped golf ball package of the present invention.
Figure 2:
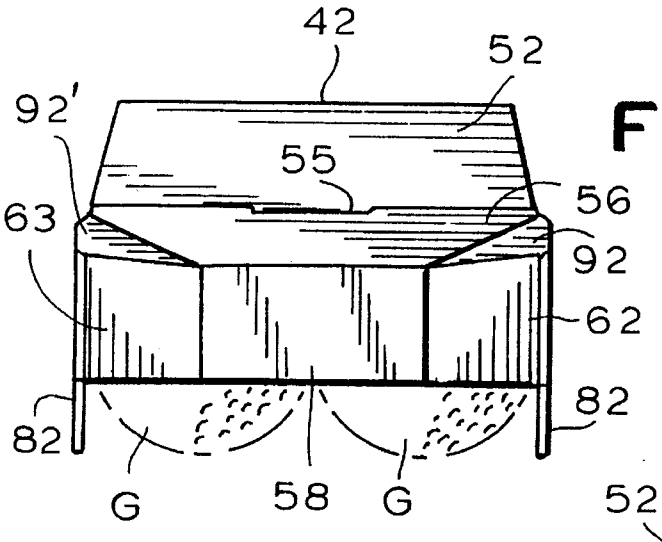
FIG. 2 is a front elevational view of the new package.
Figure 3:
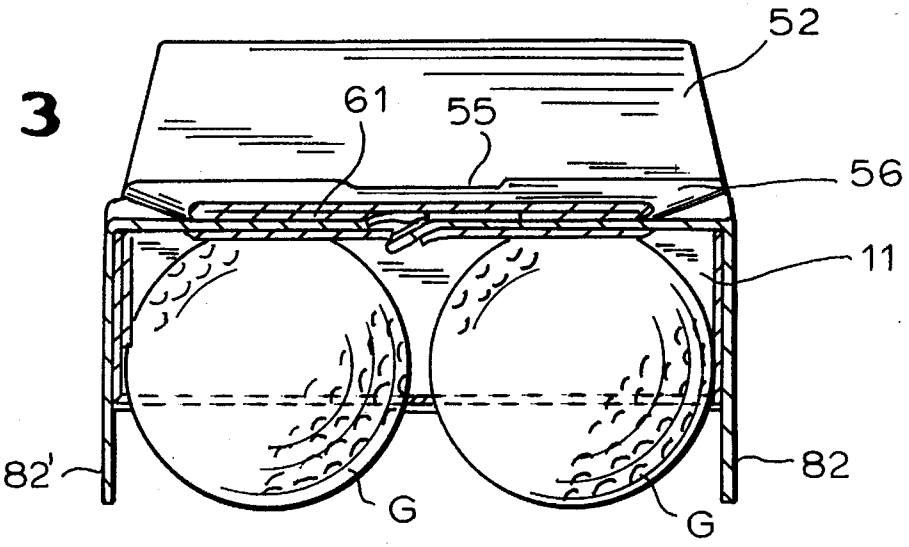
FIG. 3 is a cross-sectional view of the new package taken along line 3—3 of FIG. 1.
Figure 4:
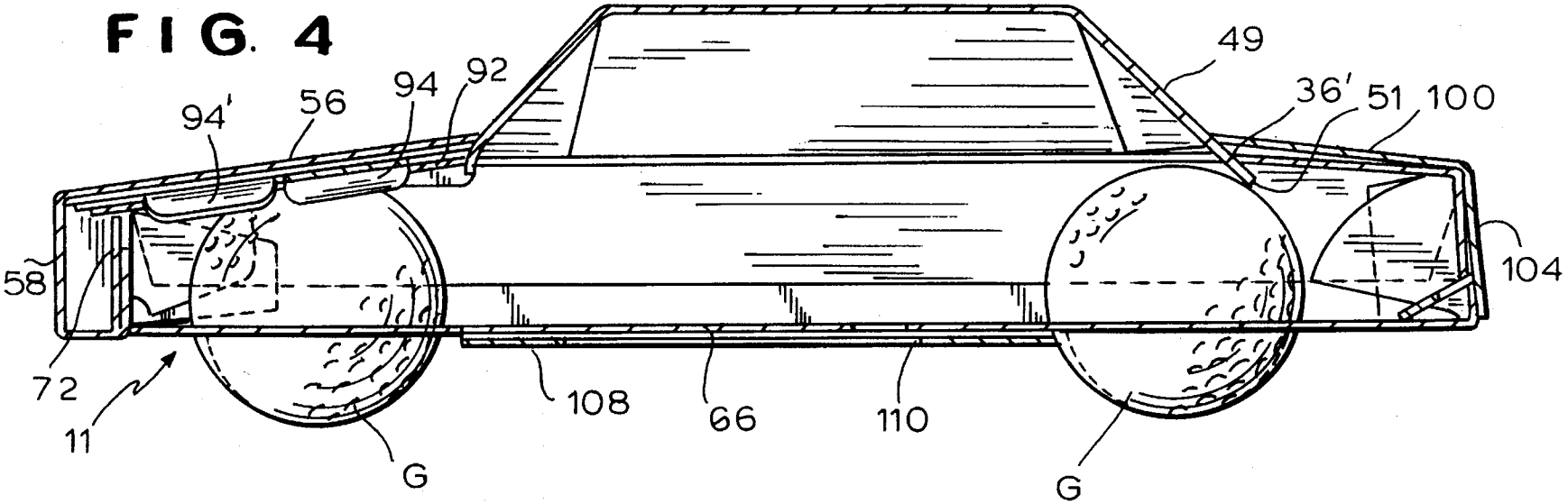
FIG. 4 is a cross-sectional view of the package taken along line 4—4 of FIG. 1.
Figure 5:
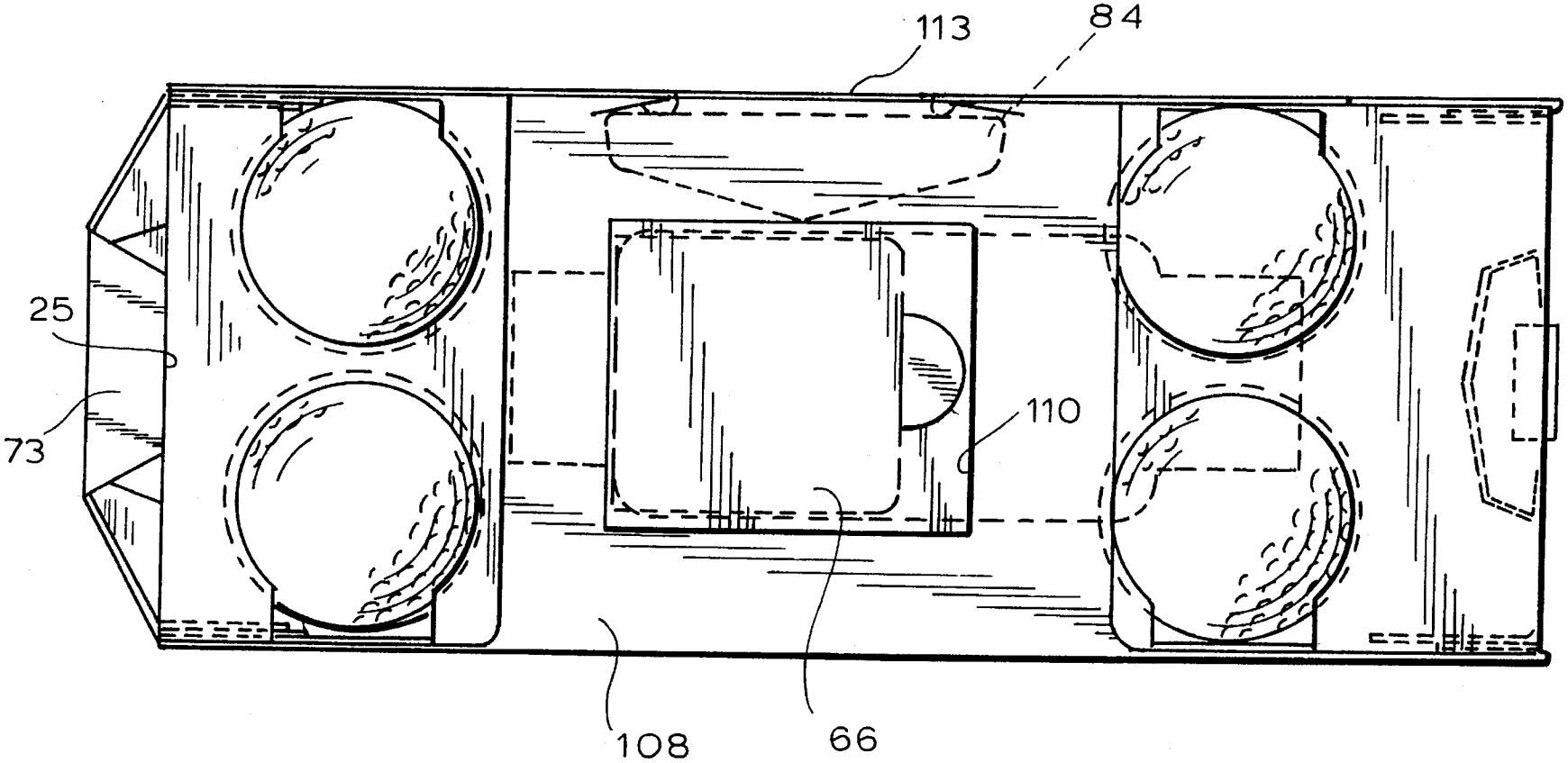
FIG. 5 is a bottom plan view of the golf ball package of the new invention.
Figure 6:
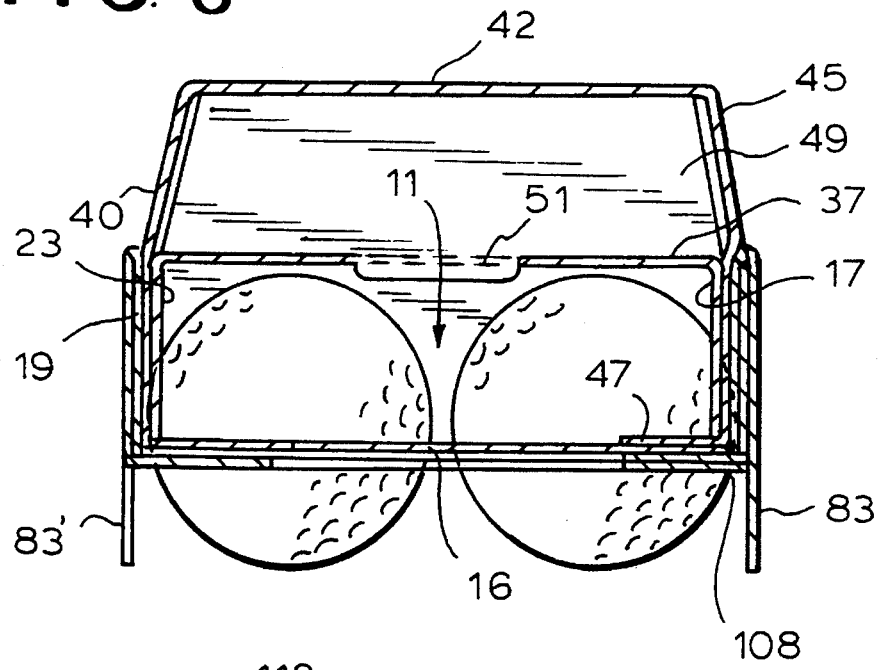
FIG. 6 is a cross-sectional view taken along line 6—6 of FIG. 1.

While a functioning automobile or other vehicular shaped golf ball retaining package may often be assembled from a single blank such as shown in FIG. 8, the wraparound additional element formed by the blank of FIG. 7 in combination with the chassis structure formed by the blank of FIG. 8 will provide the highly detailed and strong vehicular shaped golf ball package shown in FIG. 1, which package includes a vehicle with a hood, a grille, wheel covers, front and rear windows, as well as side windows. It therefore has a comparatively high degree of verisimilitude.

Specifically, the golf ball package of FIG. 1 may be assembled from the blanks of FIGS. 7 and 8 as follows. The chassis portion of the package is formed into an open sleeve as described hereinabove; however, the hood elements 56, 61 and the associated grille elements 58, 62, and 63 are not infolded until a supplementary wraparound structure is added to the chassis.

The wraparound structure is formed by folding the skirt panels 81, 81' along score lines 87, 87', infolding the panels 86, 86' and slipping this structure over the assembled roof portions of the chassis structure. Then the panels 92, 92' are folded to form generally an inner hood portion while the bottom panel 108 is superimposed over the chassis bottom panel and the locking tongue 84 is inserted into the locking slot 113 to hold the superimposed supplemental structure over the chassis. The golf balls G may be then locked into the sleeve and into the openings 12, 13, 14, 15. The four golf balls may be loaded into the sleeve and they will be retained in the openings 12, 13, 14, and 15 by the pressure of the superimposed board portion 37 of the panel 21. In this fashion the wheel covers 82, 83, 82', 83' will cover the packaged golf balls.

The hood panel 56 is then folded over panels 92, 92'. The entire assembly is then completed by infolding flaps 90, 90', 88, 88' and folding flap 104 into superimposition with the underlying chassis so as to establish a rear deck 100 in the golf ball package. The locking tab 106 is inserted into underlying slot 20 of the chassis element as will be understood. The top structure is completed by inserting the tabs 94, 94' into the slots 33 formed in the sleeve panel 21 described hereinabove and inserting tab 55 into the opening 36 against the edge 36'. The grille flaps 63, 64 will be tucked in and assembled to the front edges of the side panels 17, 19 after the assembly tab 72 is inserted into the corresponding slot 27. As shown, the assembly tab 72 is generally arrow shaped and is articulated to the bottom edge of the grille panel 58 by an intervening assembly panel 73 connected to the tab 72 along score line 74 and connected to the bottom of the grille panel 58 by score line 75.

It will be appreciated that the present invention may be produced from a single piece of paperboard or a suitably laminated paperboard product or a plastic sheet which is appropriately cut and scored to produce the blanks from which the new golf ball package may be made. It is contemplated that the blank or blanks (when a supplemental, wraparound structure such as illustrated hereinabove in FIG. 7 is employed) are to be folded and glued into appropriate preforms where desired or found necessary which can then be squared, filled with golf balls, and then completely assembled by appropriate folding and insertion of locking tabs to complete the manufacture of the product. The particular geometry may be varied as desired to establish different shaped vehicles of particular car manufacturers when the package is used as a promotional device.

It will be appreciated that the new and approved vehicular shaped package has utility not only as a packaging medium for golf balls but also as a toy with moving wheels, the golf balls themselves, when the package is loaded as well as having utility as a vehicle shaped toy after the golf balls are removed.

Although the foregoing description has been given by way of a preferred embodiment, it will be understood by those skilled in the art that other forms of the invention falling within the ambit of the following claims are contemplated. Accordingly, reference should be made to the following claims in determining the full scope of the invention.

I claim:

1. A golf ball package in the shape of a toy vehicle having a chassis and four wheels of predetermined diameter comprising a paperboard blank cut, scored, folded, and glued to form (a) an element in the general form of a sleeve representative of such chassis and having a bottom wall, first side wall, top wall, second side wall, and glue lap consecutively articulated;

(b) the height of said sleeve element being less than the diameter of a golf ball:

(c) said bottom wall having a plurality of circular openings formed therein proximate to said side walls;

(d) said openings having diameters less than that of golf balls to be packaged therein whereby portions of the golf balls may project outwardly from the sleeve element to function as wheels and for rotation in said openings;

(e) said package being adopted to be movable along a flat surface as a toy when filled with golf balls.

2. The package of claim 1, further including (a ) a plurality of golf balls disposed in said sleeve element in said circular openings;

(b) said package being freely rollable along a flat surface with said golf balls functioning as roller bearings.

3. A blank for forming a golf ball sleeve in the shape of a toy vehicle having a chassis and wheels, (a) said blank having a plurality of consecutively articulated wall panels;

(b) one of said wall panels including four substantially circular openings sized for supporting each a golf ball in roller-bearing association with the sleeve when the sleeve is squared, glued, and filled with golf balls;

(c) whereby said blank when formed into the sleeve is adapted to be rollable as a toy vehicle and to function as a package for golf balls.

4. A package in the form of a toy vehicle comprising (a) a cut, folded, scored, and glued paperboard blank formed into a sleeve structure generally having a chassis element and wheels;

(b) said chassis element having a plurality of circular openings formed therein;

(c) a plurality of balls removably housed with said sleeve structure in said openings and supporting said chassis element for rolling movement.

5. The package of claim 4, in which (a) said sleeve structure further includes auxiliary panels and flaps providing said package with a specifically customized shape conforming to a particular style of vehicle.

6. The package of claim 4, in which (a) four openings are formed in said chassis in tandem at the front and rear portions of said sleeve structure.

7. The package of claim 6, in which (a) said sleeve structure includes wheel cover elements in juxtaposition with portions of said balls projecting through said openings.

* * * * *